US007255530B2

(12) United States Patent
Vogiatzis et al.

(10) Patent No.: US 7,255,530 B2
(45) Date of Patent: Aug. 14, 2007

(54) VANE AND THROAT SHAPING

(75) Inventors: Costas Vogiatzis, Gilbert, AZ (US); Nidal A. Ghizawi, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 113 days.

(21) Appl. No.: 11/007,769

(22) Filed: Dec. 8, 2004

(65) Prior Publication Data

US 2005/0220616 A1 Oct. 6, 2005

Related U.S. Application Data

(60) Provisional application No. 60/529,078, filed on Dec. 12, 2003.

(51) Int. Cl.
*F01D 17/16* (2006.01)

(52) U.S. Cl. ..... 415/159

(58) Field of Classification Search ..... 415/159, 415/160, 162, 163, 164
See application file for complete search history.

(56) References Cited

U.S. PATENT DOCUMENTS

| | | | | |
|---|---|---|---|---|
| 3,495,921 | A * | 2/1970 | Swearingen | 415/163 |
| 4,242,040 | A | 12/1980 | Swearingen | |
| 4,770,603 | A | 9/1988 | Engels et al. | |
| 5,299,909 | A | 4/1994 | Wulf | |
| 5,636,968 | A * | 6/1997 | Audet et al. | 415/160 |
| 6,435,821 | B1 * | 8/2002 | Nicolson et al. | 415/161 |
| 2002/0094284 | A1 | 7/2002 | Arnold | |
| 2003/0079474 | A1 | 5/2003 | Finger et al. | |
| 2003/0115869 | A1 | 6/2003 | Gerke et al. | |
| 2004/0223840 | A1 | 11/2004 | Vogiatzis | |

FOREIGN PATENT DOCUMENTS

| | | |
|---|---|---|
| DE | 10212032 A1 | 10/2003 |
| EP | 1260675 | 5/2002 |
| JP | 11229815 | 8/1999 |
| JP | 11257011 | 8/1999 |
| JP | 2001132464 | 5/2001 |
| JP | 2001173449 | 6/2001 |

OTHER PUBLICATIONS

PCT ISR WO, Aug. 7, 2005, Honeywell.

* cited by examiner

*Primary Examiner*—Edward K. Look
*Assistant Examiner*—Devin Hanan
(74) *Attorney, Agent, or Firm*—Chris James; Faisal Adnan

(57) ABSTRACT

An exemplary vane for a radial turbine assembly includes a hub end and a shroud end that define vane height, a leading edge and a trailing edge that define vane length along a camberline and an inner surface and an outer surface that extend from the hub end to the shroud end and meet at the leading edge and the trailing edge and that define vane thickness wherein, for at least a portion of the vane, vane length and vane thickness vary with respect to vane height. Other exemplary vanes, assemblies, methods, etc., are also disclosed.

17 Claims, 14 Drawing Sheets

EXEMPLARY TURBOCHARGER

VANE AND THROAT SHAPING

RELATED APPLICATIONS

This application claims the benefit of U.S. Provisional Application 60/529,078, entitled "Vane and Throat Shaping", filed Dec. 12, 2003, to Vogiatzis, which is incorporated herein by reference.

TECHNICAL FIELD

Subject matter disclosed herein relates generally to turbomachinery for internal combustion engines and, in particular, vanes for variable geometry turbines.

BACKGROUND

Conventional vanes used in variable geometry turbochargers or variable nozzle turbochargers typically have a two-dimensional cross-section or profile that remains constant in shape along the axis of rotation of a turbine. As discussed herein, exemplary vanes have a two-dimensional cross-section that may vary, for example, in a direction parallel to the axis of rotation of a turbine. Such exemplary vanes can provide enhanced performance when compared to conventional vanes.

BRIEF DESCRIPTION OF THE DRAWINGS

A more complete understanding of the various methods, devices, systems, arrangements, etc., described herein, and equivalents thereof, may be had by reference to the following detailed description when taken in conjunction with the accompanying drawings wherein.

DETAILED DESCRIPTION

Figure 1:
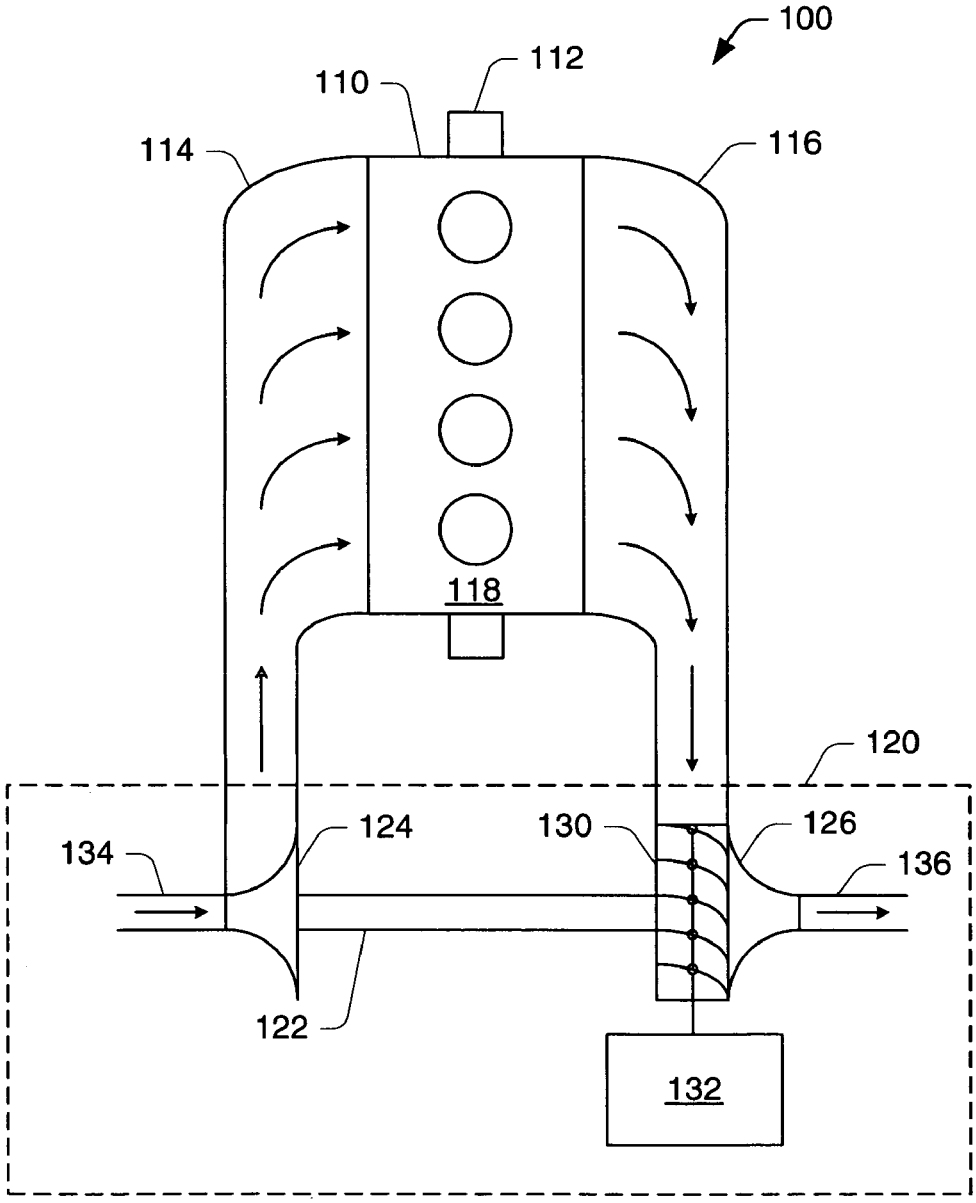
Fig.1 (Prior Art)
FIG. 1 is a simplified approximate diagram illustrating a turbocharger with a variable geometry mechanism and an internal combustion engine.

Various exemplary methods, devices, systems, arrangements, etc., disclosed herein address issues related to technology associated with turbochargers. Turbochargers are frequently utilized to increase the output of an internal combustion engine. Referring to FIG. 1, an exemplary system 100, including an exemplary internal combustion engine 110 and an exemplary turbocharger 120, is shown. The internal combustion engine 110 includes an engine block 118 housing one or more combustion chambers that operatively drive a shaft 112. As shown in FIG. 1, an intake port 114 provides a flow path for air to the engine block while an exhaust port 116 provides a flow path for exhaust from the engine block 118.

The exemplary turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor 124, a turbine 126, a variable geometry unit 130, a variable geometry controller 132 and an exhaust outlet 136. The variable geometry unit 130 optionally has features such as those associated with commercially available variable geometry turbochargers (VGTs), such as, but not limited to, the GARRETT® VNT™ and AVNT™ turbochargers, which use multiple adjustable vanes to control the flow of exhaust across a turbine.

Adjustable vanes positioned at an inlet to a turbine typically operate to control flow of exhaust to the turbine. For example, GARRETT® VNT™ turbochargers adjust the exhaust flow at the inlet of a turbine in order to optimize turbine power with the required load. Movement of vanes towards a closed position typically increases the pressure gradient across the turbine and directs exhaust flow more tangentially to the turbine, which, in turn, imparts more energy to the turbine and, consequently, increases compressor boost. Conversely, movement of vanes towards an open position typically decreases the pressure gradient and directs exhaust flow in more radially to the turbine, which, in turn, reduces energy to the turbine and, consequently, decreases compressor boost. Thus, at low engine speed and small exhaust gas flow, a VGT turbocharger may increase turbine power and boost pressure; whereas, at full engine speed/load and high gas flow, a VGT turbocharger may help avoid turbocharger overspeed and help maintain a suitable or a required boost pressure.

A variety of control schemes exist for controlling geometry, for example, an actuator tied to compressor pressure may control geometry and/or an engine management system may control geometry using a vacuum actuator.

Overall, a VGT may allow for boost pressure regulation which may effectively optimize power output, fuel efficiency, emissions, response, wear, etc. Of course, an exemplary turbocharger may employ wastegate technology as an alternative or in addition to aforementioned variable geometry technologies.

Figure 2:
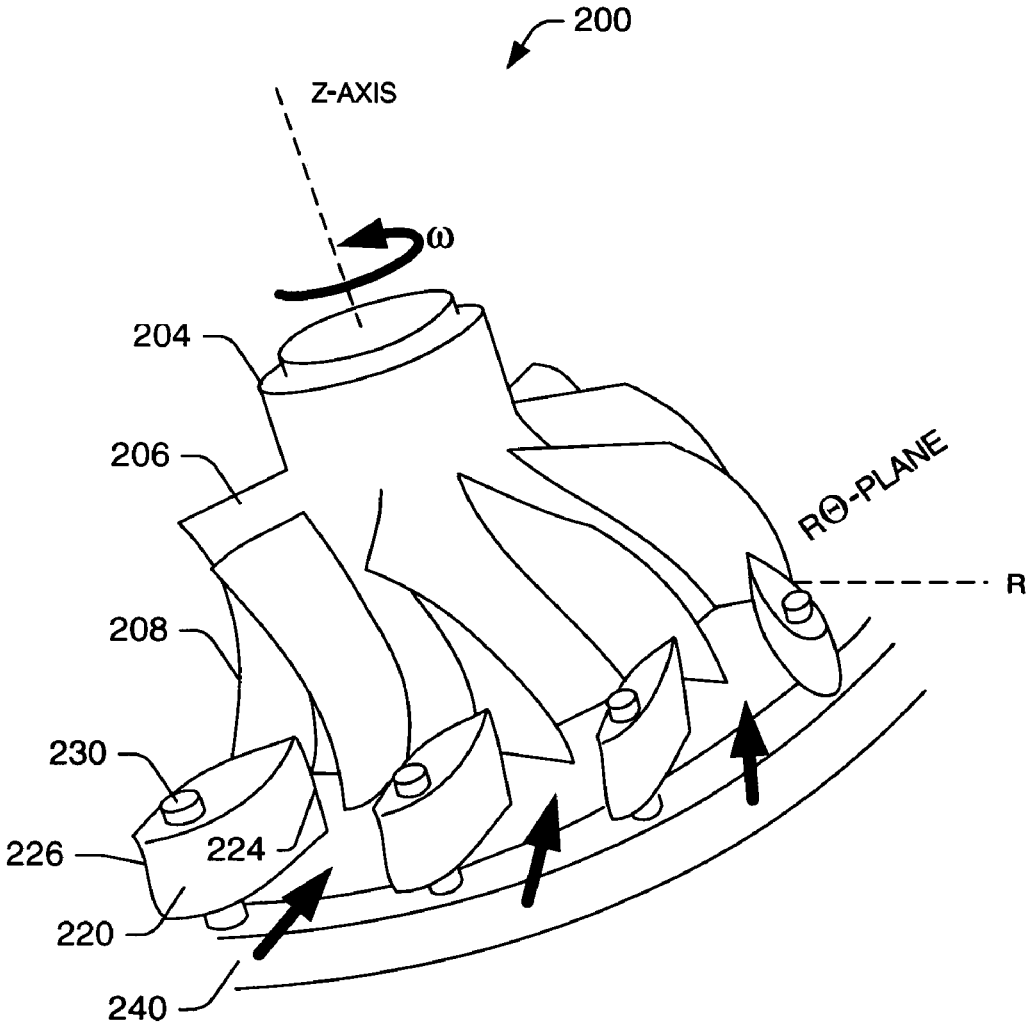
Fig.2 (Prior Art)
FIG. 2 is an approximate perspective view of a turbine and vanes, which may be associated with a variable geometry mechanism.

FIG. 2 shows an approximate perspective view a system 200 having a turbine wheel 204 and vanes 220 associated with a variable geometry mechanism. The turbine wheel 204 is configured for counter-clockwise rotation, when looking from the nose of the wheel to the back, (e.g., at an angular velocity $\omega$) about the z-axis. Of course, an exemplary system may include an exemplary turbine wheel that rotates clockwise. The turbine wheel 204 includes a plurality of blades 206 that extend primarily in a radial direction outward from the z-axis. Each of the blades 206 has an outer edge 208 wherein any point thereon can be defined in an r, $\Theta$, z coordinate system (e.g., a cylindrical coordinate system).

In this example, the vanes 220 are positioned on posts 230, which are set in a vane base 240, which may be part of a variable geometry mechanism. In the system of FIG. 2, the individual posts 230 are aligned substantially parallel with the z-axis of the turbine wheel 204. Each individual vane 220 has an outer or leading edge 226 and an inner or trailing edge 224, which are adjustable via vane rotation. For example, a variable geometry mechanism can allow for rotatable adjustment of one or more trailing edges 224 to alter exhaust pressure and flow to the blades 206 of the turbine wheel 204. Typically, adjustment involves adjusting the entire vane. As mentioned above, adjustments toward "open" reduce the pressure gradient and direct exhaust flow more radially to the turbine wheel 204; whereas, adjustments toward "closed" increase the pressure gradient and direct exhaust flow more tangentially to the turbine wheel 204.

Each vane also has an inner surface and an outer surface. The inner surface faces the turbine wheel while the outer surfaces faces away from the turbine wheel. The inner surface and the outer surface of each vane meet at the leading edge 226 and at the trailing edge 224.

In general, the outer surface experiences a higher pressure than the inner surface; thus, at times, the outer surface may be referred to as a "pressure" surface.

During operation, exhaust flows from the leading edge 226 to the trailing edge 224 of a vane. An inner surface of a vane and an outer surface of an adjacent vane form a throat. Thus, an adjustment to the vanes typically adjusts throat shape. In general, the number of throats equals the number of vanes.

Figure 3A:
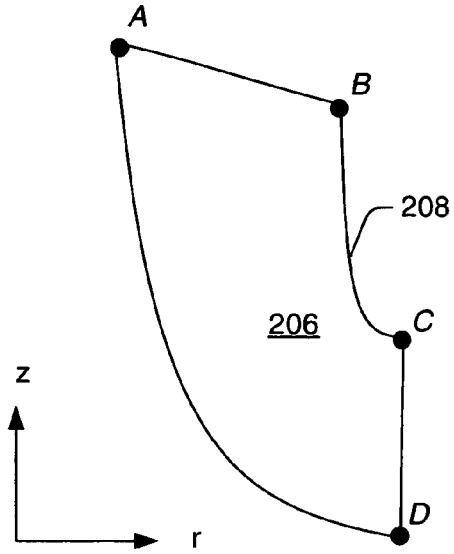
Fig.3A (Prior Art)
FIG. 3A is a side view of a conventional turbine blade suitable for use in the turbine of FIG. 2.

FIG. 3A shows a side view or side projection of a blade 206 of a traditional turbine wheel, such as the wheel 204 of FIG. 2. Various points, A-D, along the outer edge 208 of the blade 206 are shown. Point A represents the highest point along the z-axis wherein the blade 206 meets the hub portion of the turbine wheel. Point B is located at some radial distance from point A. Further, point B may be located at a lesser height along the z-axis when compared to point A. The edge from A to B is the trailing edge of the turbine blade 206.

Point C is typically located at even greater radial distance from point A and at a lesser height along the z-axis. Point D is the lowest point of the blade outer edge 208 along the z-axis. The edge from C to D is the leading edge of the turbine blade 206. In some instances, vanes may be defined with respect to the leading edge of a turbine blade. For example, an axial dimension "b" may correspond to the axial length of the leading edge of a turbine blade and be used to define a dimensionless blade parameter. A vane may also have an axial dimension "b", which corresponds to the axial length of a trailing edge of a vane. This dimension may be used to define a dimensionless vane parameter.

Various plots described herein use the axial length of a trailing edge of a vane "b" to define a dimensionless vane parameter.

Various exemplary vanes are disclosed herein. In general, vanes for variable geometry turbines have an airfoil shape that is configured to both provide a complementary fit with adjacent vanes when placed in a closed position, and to provide for the passage of exhaust gas within the turbine housing to the turbine wheel when placed in an open position. An individual vane has a leading edge or nose having a first radius of curvature and a trailing edge or tail having a substantially smaller second radius of curvature connected by an inner airfoil surface on an inner side of the vane and an outer airfoil surface on an outer side of the vane. The outer airfoil surface may be convex in shape, while the inner airfoil surface may be convex in shape near or at the leading edge and optionally concave in shape near the trailing edge. The inner and outer airfoil surfaces are defined by a substantially continuous curve which complement each other. As used herein, the vane surfaces are characterized as "concave" or "convex". The asymmetric shape of such a vane results in a curved centerline, which is also commonly referred to as the camberline of the vane. The camberline is the line that runs through the midpoints between the vane inner and outer airfoil surfaces between the leading and trailing edges of the vane. Its meaning is well understood by those skilled in the relevant technical field. A vane with a curved camberline, may be referred to as a "cambered" vane.

Figure 3B:
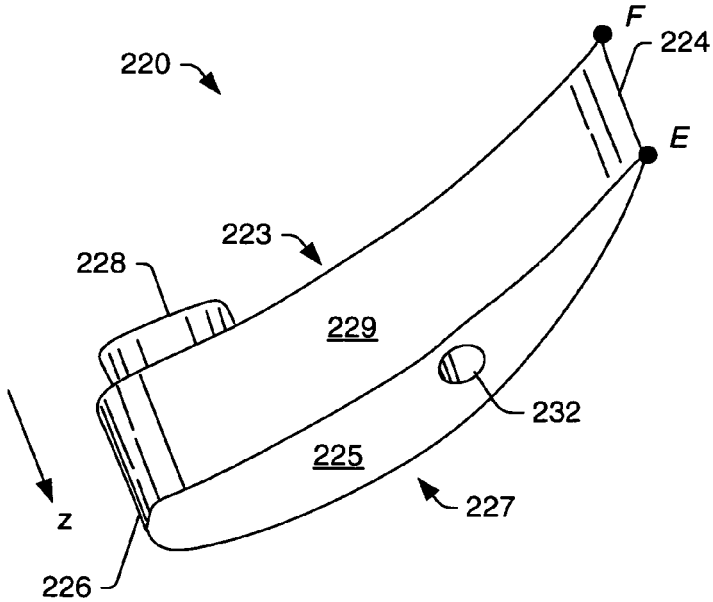
Fig.3B (Prior Art)
FIG. 3B is a perspective view of a conventional vane suitable for use in the turbine of FIG. 2.

FIG. 3B shows a perspective view of a vane 220 of a traditional variable geometry mechanism such as the system 200 of FIG. 2. The vane has a trailing edge 224, a leading edge 226 and a prong 228 located near the leading edge 226. An aperture 232 and the prong 228 (or tab) typically allow for angular adjustment of the vane 220. The trailing edge 224 has a lower point F (hub end) and an upper point E (shroud end), at a higher position along the z-axis. A position along the length of the trailing edge of the vane 220 may be rendered dimensionless by dividing by the axial length FE of the vane.

In FIG. 3B, the surface 229 is the inner surface of the vane 220, which can form a throat with an outer surface of an adjacent vane (note that while the outer surface 227 of the vane 220 is not shown in FIG. 3B, a label 227 appears pointing to this outer surface).

A vane thickness may be defined as the distance between the inner surface and the outer surface of a vane, for example, with respect to a local coordinate system wherein the normal to a plane tangent to a surface of the vane is used to define a direction to measure vane thickness.

Substantially crescent shaped surfaces 223, 225 of the vane 220 are referred to as an upper axial surface or shroud end surface 225 and a lower axial surface or hub end surface 223 (note that while the hub end surface 223 of the vane 220 is not shown in FIG. 3B, a label 223 appears point to this hub end surface). A vane height may be defined as the distance between these two surfaces where the distance or height is parallel to the z-axis. The various vane surfaces may be defined relative to vane placement with respect to a turbine wheel, as shown in FIG. 2.

Figure 3C:
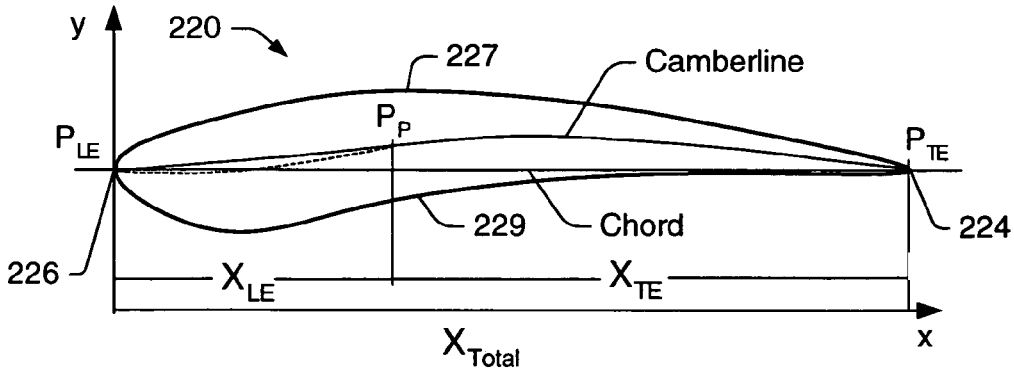
Fig.3C (Prior Art)
FIG. 3C is a top view of a vane suitable for use in the turbine of FIG. 2.

FIG. 3C is a top view of a conventional cambered vane 220 with reference to an xy-coordinate system (the aforementioned z-axis of the turbine coordinate system extends out of the page). As shown in FIG. 3C, the cambered vane 220 includes an outer airfoil surface 227 that is substantially convex in shape and that is defined by a composite series of curves, and an opposite inner airfoil surface 229 that includes convex and concave-shaped sections and that is also defined by a composite series of curves. A leading edge 226 coincides with a leading edge point ($P_{LE}$), which in this conventional example is constant with respect to the z-axis.

In general, for the xy-coordinate system shown, an overall minimum $P_{LE}$ is located at a minimum x value. The trailing edge 224 coincides with a trailing edge point ($P_{TE}$), which in this conventional example is constant with respect to the z-axis. In general, for the xy-coordinate system shown, an overall maximum $P_{TE}$ is located at a maximum x value. The y-axis is normal to the x-axis and runs to the outer side of the vane in the direction in which the outer airfoil surface 227 extends. As described herein, various exemplary vanes include one or more minimum $P_{LE}$s and one or more maximum $P_{TE}$s. Further, in such exemplary vanes, the minimum $P_{LE}$(s) may be located at z-axis position(s) that differ from the maximum $P_{TE}$(s).

In conventional vanes, the leading edge 226 is typically defined by a circular curve having a first radius of curvature r (not shown), and the trailing edge 224 is defined by a circular curve having a substantially smaller second radius of curvature. As described herein, various exemplary vanes may include a leading edge that is defined by more than one circular curve radii or a trailing edge that is defined by more than one circular curve radii. For example, at the leading edge the curve may be elliptical with the major axis along the direction of the camber line and an aspect ratio in a range from about 2 to about 4 (defined as the ratio of major over minor ellipse axes) may be used.

With respect to vane length, a commonly used measure is the chord length. The chord length is defined as a straight line length along "x" from the leading edge to the trailing edge at a constant z-axis value (i.e., a cross section in the x-y plane normal to the z-axis of the turbine coordinate system). Further, the pivot point ($P_P$) of a vane may be located with respect to x and y coordinates. The chord length from $P_P$ to $P_{TE}$ is referred to as $X_{TE}$ while the chord length from $P_P$ to $P_{LE}$ is referred to as $X_{LE}$.

Another point that may be associated with the vane 220 is an inflection point, which demarcates the transition of the inner surface 229 from concave to convex.

The convex section resembles a parabolic curve that potentially transitions into a short circular or elliptic curve connecting the parabolic curve and the concave section. The vertex of the parabolic curve defines a local extreme of curvature. For a vane with such a concave to convex transition, the camberline is represented in FIG. 3C by a dashed line while a solid line represents an example of a camberline for a vane without such a transition.

In general, if the camber line is even partially concave (as seen from the inner surface) then the inner surface will transition from convex to concave.

Figure 3D:
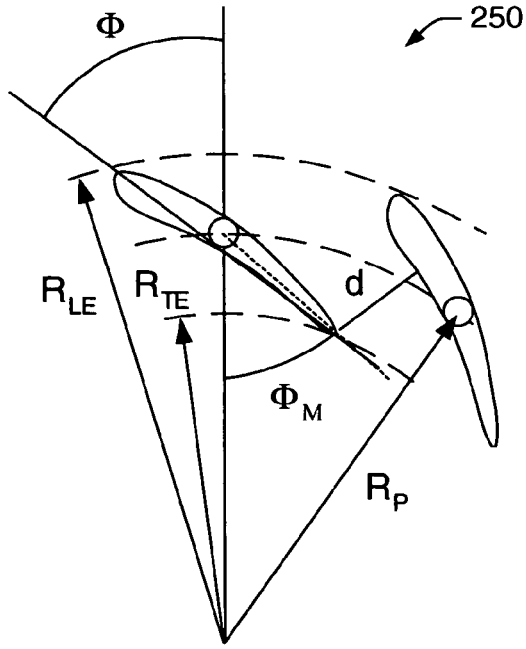
Fig.3D (Prior Art)
FIG. 3D is a top view of an arrangement of conventional vanes suitable for use in the turbine of FIG. 2.

FIG. 3D shows a portion of an arrangement for conventional vanes 250. The arrangement 250 includes a leading edge radius ($R_{LE}$), a trailing edge radius ($R_{TE}$), a pivot point radius ($R_P$) and a stagger angle ($\Phi$). A chord is shown for one of the vanes together with a radial line from the center of rotation of a turbine wheel through the pivot point of the vane. These two lines define a stagger angle $\Phi$, which for conventional vanes is constant with respect to position along the z-axis (out of the page), consequently, the pivot angle of the vane with respect to a turbine wheel may be defined based on the stagger angle. As described herein, various exemplary vanes include a stagger angle, for a given vane rotational position, that varies with respect to position along the z-axis. Thus, for such exemplary vanes, a plurality of stagger angles may exist. Another type of "stagger" angle may be defined by a line that passes from a point on the trailing edge through the pivot point, which, in a conventional vane, is an angle that is typically constant with respect to position along the z-axis. This pivot-based, trailing edge stagger angle or "modified stagger angle" ($\Phi_M$) may be used to characterize a vane shape where the leading edge is not constant with respect to position along the z-axis. In particular, the modified stagger angle aims to describe variations in the trailing edge that can affect throat shape, as created by adjacent vanes. Also note that the modified stagger angle $\Phi_M$ may, in some instances, not correspond to the pivot angle of a vane.

In general, vanes pivot between a minimum and a maximum stagger angle $\Phi$. At the maximum stagger angle $\Phi$, the vanes are in a closed position defining a minimum throat distance or throat width (d) between two adjacent vanes. At the minimum stagger angle $\Phi$, the vanes are in an open position defining a maximum throat distance d. When the vanes pivot between the minimum and maximum stagger angles, the vane leading edges define a first radius $R_{LE}$ and the vane trailing edges define a second radius $R_{TE}$ which is smaller than the first radius $R_{LE}$.

Referring again to FIG. 3B, the conventional vane 220 includes a trailing edge 224 and a leading edge at opposite common ends of the inner surface 229 and the outer surface 227. The vane includes a prong 228 or tab projecting outwardly away from the hub end surface 223 and positioned proximate to the leading edge 226. Often, such a prong is configured to cooperate with a unison ring slot to facilitate vane adjustment (e.g., rotation about a vane's pivot point). In this particular traditional vane 220, the trailing edge 224 (e.g., along the segment E to F), is straight and parallel to the z-axis. A vane may have an aperture or a shaft optionally along with a prong or a tab or other mechanical feature to facilitate adjustment. Thus, a variety of means or mechanisms may be used to adjust a vane and a vane may optionally have any of a variety of features that operate in conjunction with such mechanisms.

Exemplary vanes described herein can be formed from the same types of materials, and in various instances in the same manner, as that used to form traditional vanes (e.g., the vane 220). Exemplary vanes may have a substantially solid design or may alternatively have a cored out design.

A cored out design may provide better formability, a higher stiffness to weight ratio, be more cost effective to produce, and have a reduced mass when compared to solid vanes.

Figure 4:
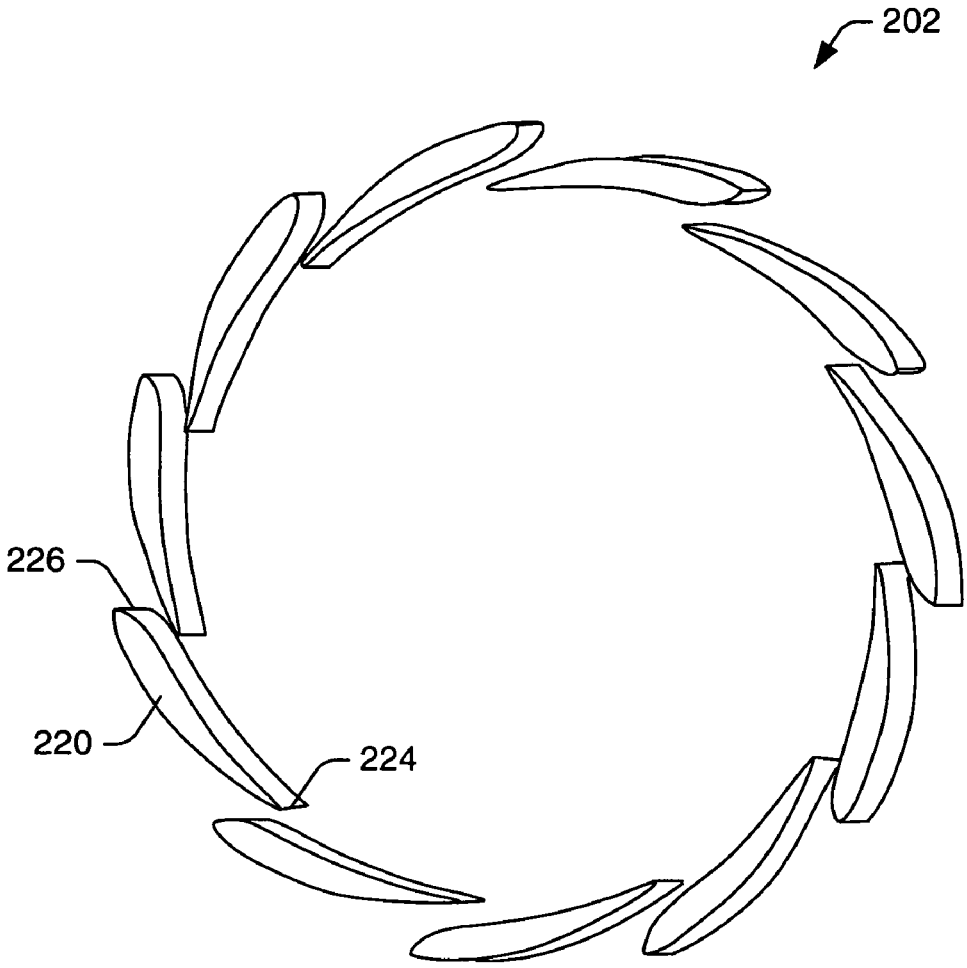
Fig.4 (Prior Art)
FIG. 4 is a perspective view of a plurality of vanes as arranged, for example, in a variable geometry turbocharger.
Figure 5:
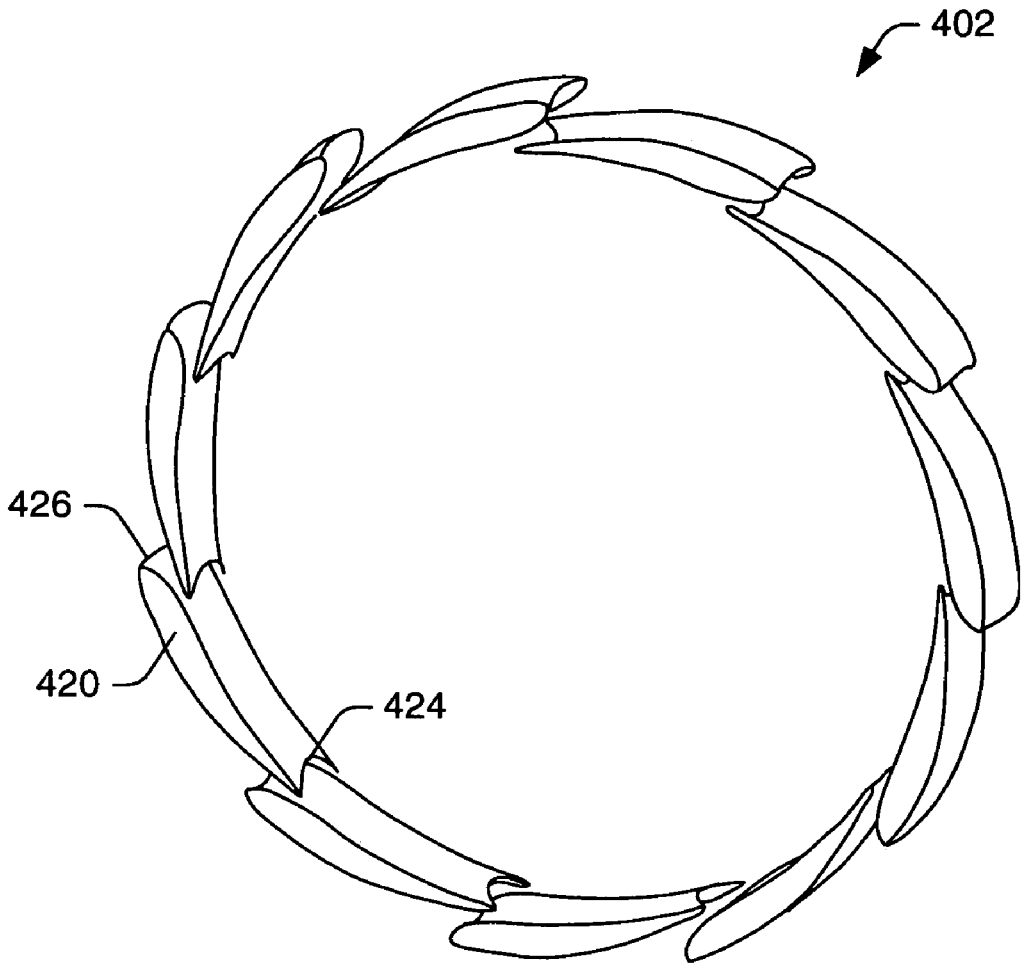
FIG. 5 is a perspective view of a plurality of exemplary vanes as arranged, for example, in a variable geometry turbocharger.

FIG. 4 shows a perspective view of a plurality of conventional vanes 202 arranged, for example, in a variable geometry unit. Each vane 220 includes a leading edge 226 and a trailing edge 224. FIG. 5 shows a perspective view of a plurality of exemplary vanes 402 arranged, for example, in a variable geometry unit. Each of the exemplary vanes includes a leading edge 426 and a trailing edge 424 and has a chord length between the leading edge 426 and the trailing edge 424 that varies with respect to axial distance (distance parallel to z-axis). Of course, a combination of vanes of varying shape may be used thereby optionally defining more than one throat shape.

Figure 6A:
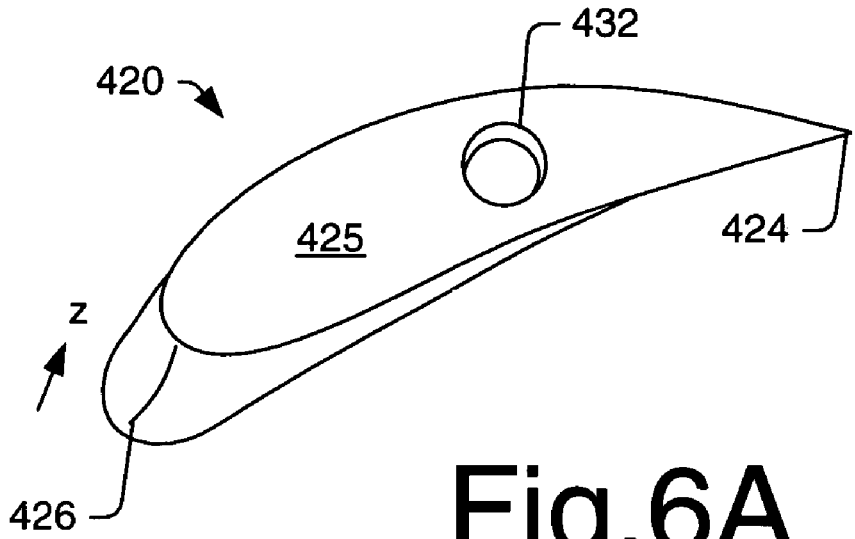
FIG. 6A is a perspective view of an exemplary vane of the present invention.
Figure 6B:
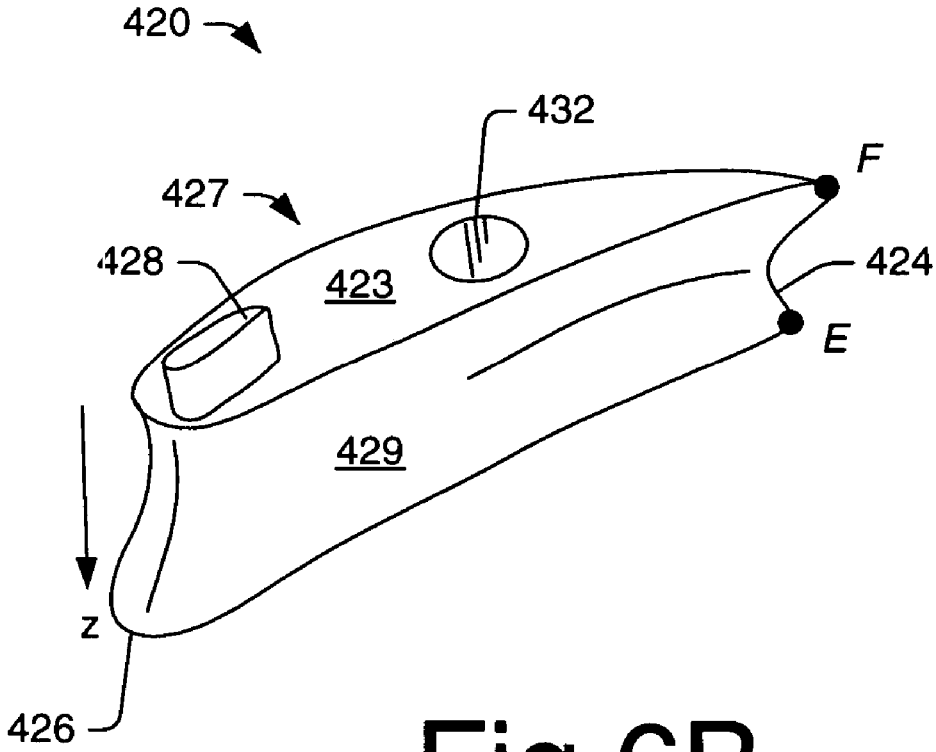
FIG. 6B is a perspective view of an exemplary vane and wherein chord length and stagger angle vary with respect to the z-axis.

FIGS. 6A and 6B show various perspective views of an exemplary vane 420. FIG. 6A shows a top perspective view of the exemplary vane 420 having an aperture 432, a shroud end surface 425, a trailing edge 424 and a leading edge 426 wherein the z-axis generally corresponds with an axis of rotation of a turbine wheel. FIG. 6B shows a bottom perspective view of the exemplary vane 420 having a prong 428, an aperture 432, a hub end surface 423, a trailing edge 424 and a leading edge 426 wherein the z-axis generally corresponds with an axis of rotation of a turbine wheel. A substantially concave, inner surface 429 is also fully shown in FIG. 6B (while the corresponding outer surface of the vane 420 is not shown, a label 427 points to the location of this surface). The exemplary vane 420 has a chord length that varies with respect to the z-axis and an inner surface 429 and an outer surface 427 that vary with respect to the z-axis.

Figure 7A:
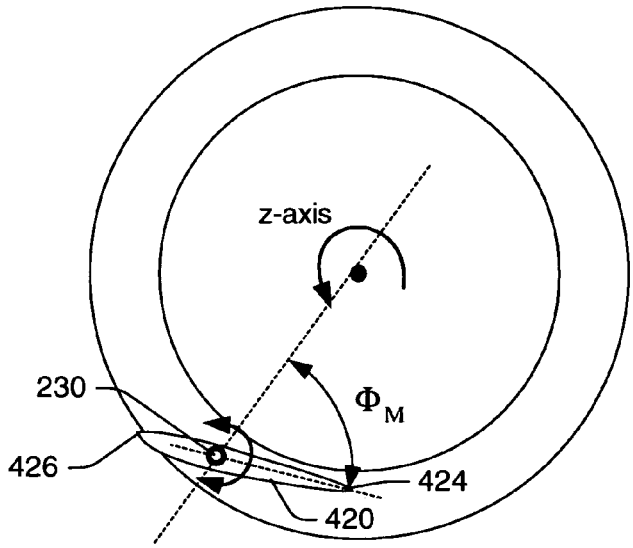
FIG. 7A is a simplified diagram that illustrates stagger angle.

FIG. 7A shows a simplified diagram that illustrates a modified stagger angle ($\Phi_M$), i.e., the pivot-based, trailing edge stagger angle as mentioned above.

As described herein, an exemplary vane may have a modified stagger angle $\Phi_M$ that varies with respect to axial position (e.g., position parallel to the z-axis). In FIG. 7A, a line passes through the axis of rotation of a wheel and a pivot axis of a post 230 of a vane 420. Another line passes approximately along a leading edge 426 to a trailing edge 424 of the vane 420. An angle is formed between the trailing edge 424, the pivot axis of the vane 420 and the wheel rotation axis (z-axis), which is labeled as the modified stagger angle $\Phi_M$. A modified stagger angle $\Phi_M$ of 0° would correspond to a radial vane (along a radial line) and, for a plurality of vanes, wide throats between adjacent vanes. According to various exemplary vanes, for a given vane position, the stagger angle may vary. For example, at the hub end and the shroud end of an exemplary vane, the stagger angle may be about 60° and between these ends the stagger angle may decrease to a lesser value, which would correspond to a wider throat. Thus, for a given vane position, a throat formed between adjacent vanes may have a width that varies with respect to a stagger angle that varies over axial position.

Figure 7B:
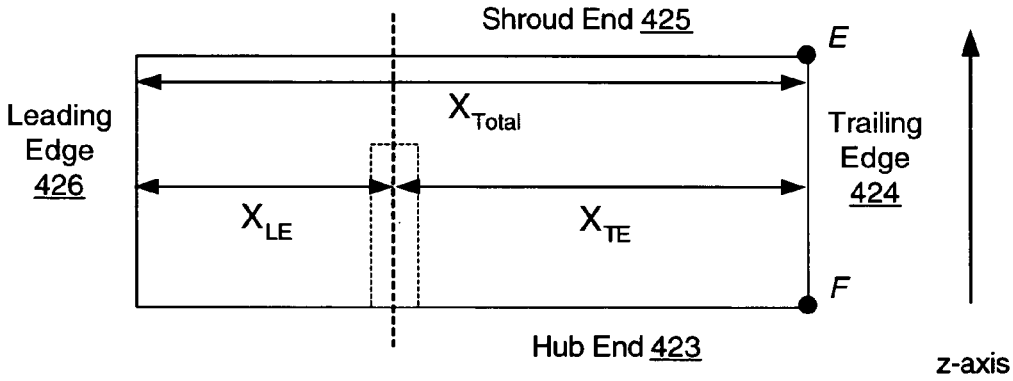
FIG. 7B is a simplified diagram that illustrates chord length and sub-lengths defined by a pivot axis of a vane.

FIG. 7B shows a simplified diagram that illustrates chord length and sub-lengths defined by a pivot axis of a vane. The sub-lengths include $X_{LE}$ and $X_{TE}$, which correspond to a length from the pivot axis to the leading edge 426 and a length from the pivot axis to the trailing edge 424 measured along the chord as shown in FIG. 3C. Segments measured from the pivot axis to a point on the leading edge or to a point on the trailing edge may be referred to as $XY_{LE}$ and $XY_{TE}$, respectively, where, for example, the direction of the segment $XY_{TE}$ is used in part to define modified stagger angle. As described herein, any of these segments or lengths may vary with respect to the z-axis (e.g., the pivot axis, the axis of rotation of a wheel, etc.). In general, the sum of the distances $X_{LE}$ and $X_{TE}$ is the chord length of the exemplary vane and $X_{Total}$.

Figure 7C:
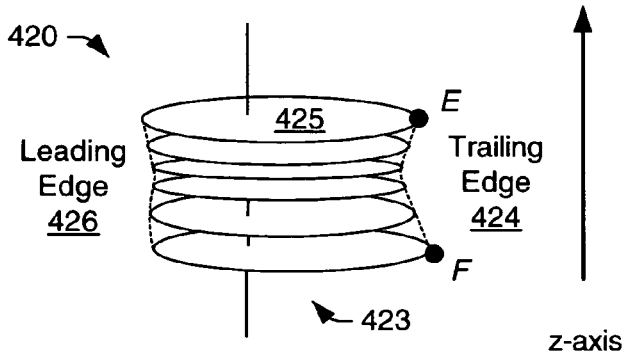
FIG. 7C is a simplified diagram that illustrates cross-section of an exemplary vane along, for example, a pivot axis.
Figure 8:
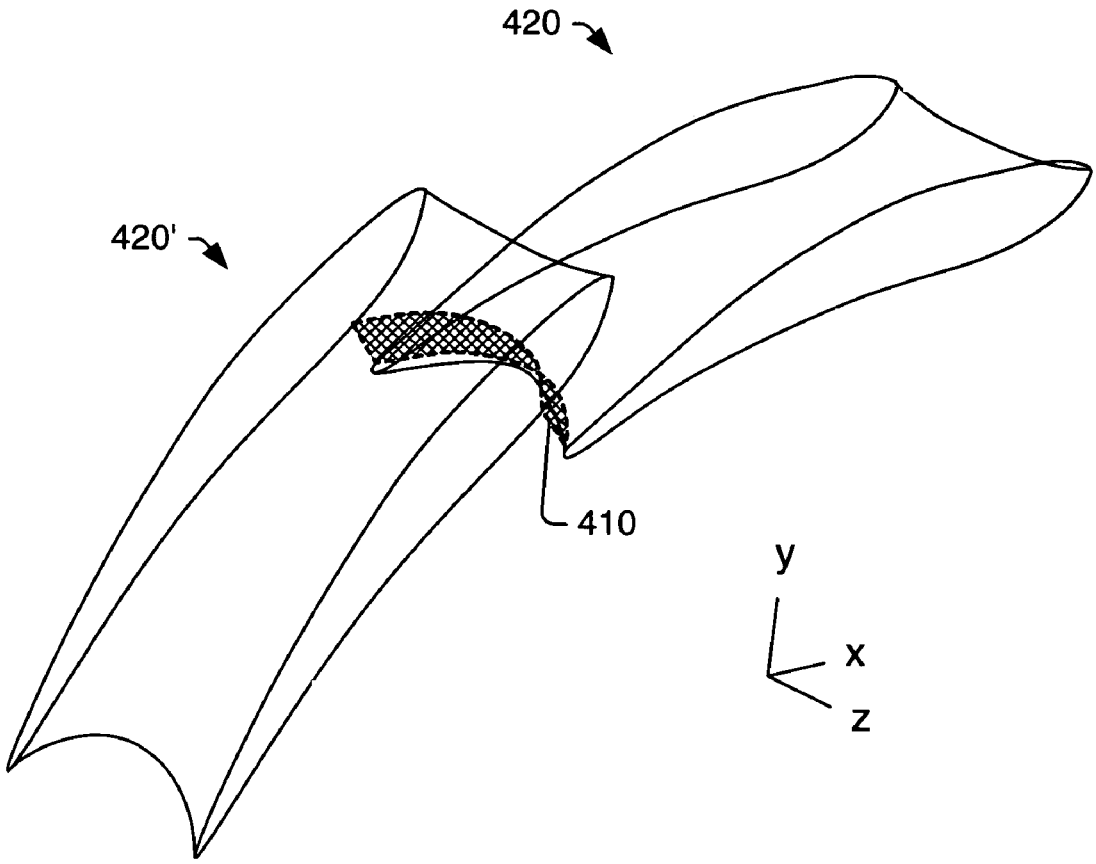
FIG. 8 is a perspective view of a throat area defined by a trailing edge of an exemplary vane and an inner surface of an adjacent exemplary vane.

FIG. 7C shows a simplified diagram that illustrates various cross-sections of an exemplary vane 420 along, for example, a pivot axis or z-axis. The exemplary vane has a leading edge 426 and a trailing edge 424 that vary with respect to the z-axis. In this example, the distances $X_{LE}$ and $X_{TE}$ and $X_{Total}$ vary with respect to the z-axis. In addition to varying shape, the cross-sectional areas of each cross-section may vary with respect to the z-axis. In this example, the cross-sectional area is at a minimum somewhere between the hub end 423 and the shroud end 425 of the exemplary vane 420. Of course, other cross-sectional variations are possible. A change in cross-sectional area may correspond to a change in modified stagger angle. A change in cross-sectional shape may correspond to a change in camberline FIG. 8 is a perspective view of a throat area 410 defined by a trailing edge of an exemplary vane 420 and the inner surface of an adjacent exemplary vane 420'.

In this example, the particular shape acts to increase efficiency and reduce fatigue when implemented in a variable geometry turbocharger. More specifically, such a throat shape acts to improve steady-state and high cycle fatigue performance.

Figure 9:
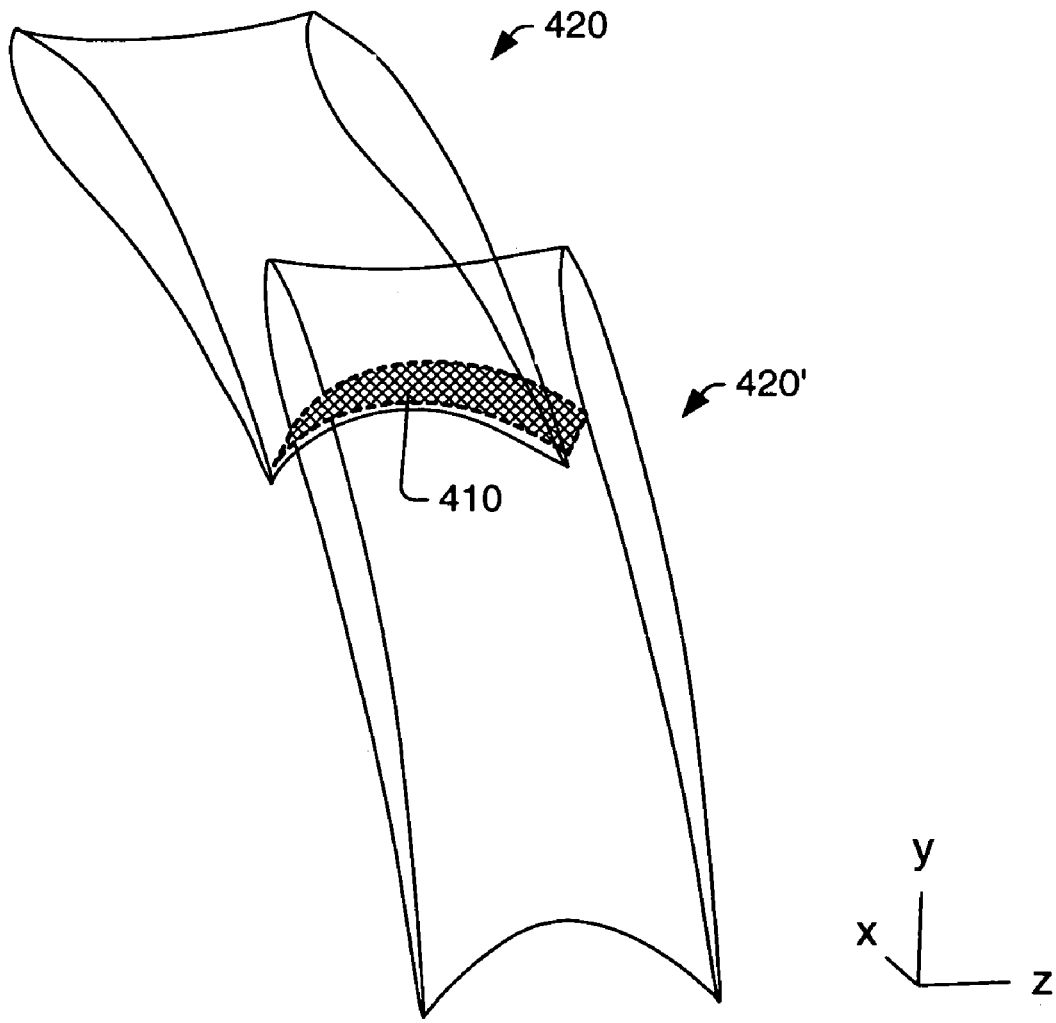
FIG. 9 is a perspective view of a throat area defined by a trailing edge of an exemplary vane and an inner surface of an adjacent exemplary vane.

FIG. 9 is another perspective view of the throat area 410 defined by the trailing edge of the exemplary vane 420 and the inner surface of the adjacent exemplary vane 420'. In FIGS. 8 and 9, the vanes 420, 420' and the throat area 410 are shown with respect to a Cartesian coordinate axis. More specific examples are shown in the plots of FIGS. 11A, 11B, 12A and 12B as vane length or stagger angle for various exemplary vanes that may form an advantageous throat shape. For example, throat shape may direct exhaust flow toward regions of a turbine wheel that can better handle stress and/or reduce flow toward regions of a turbine wheel that may be more susceptible to stress. Various throat shapes may aim to reduce noise at all speeds or at certain speeds. Of course, a combination of stress and noise criteria may be used to select a particular vane shape wherein in an assembly of such vanes a throat shape varies with respect to vane height.

Figure 10:
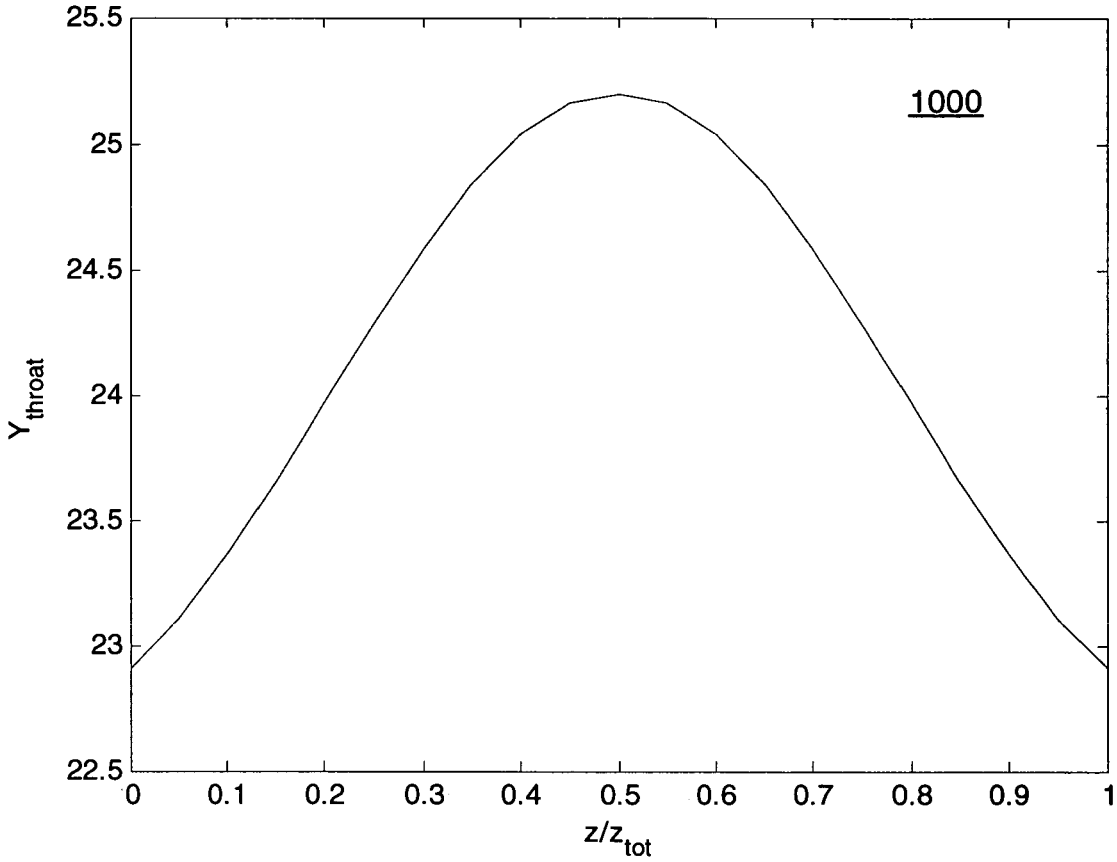
FIG. 10 is a plot of a throat dimension Y versus a dimensionless Z value defined with respect to a total Z value (see coordinate axes in FIGS. 9 and 10).

FIG. 10 is a plot of a throat dimension Y (e.g., a throat width) versus a dimensionless Z value defined with respect to a total Z value for an exemplary vane (see coordinate axes in FIGS. 9 and 10). In this example, a maximum in Y occurs at a Z value of about 0.5. Typically such a shape can act to increase efficiency and reduce fatigue when implemented in a variable geometry turbocharger.

While a dimension "b" may refer to an edge height of a vane, as previously described, it may alternatively refer to another constant, such as the maximum vane height. In such an example, dimensionless vane height values would not exceed unity. However, where a dimension "b" is less than the maximum vane height, dimensionless vane height values may exceed unity. Various exemplary vanes optionally have more than one vane height, for example, a vane height that varies from the leading edge to the trailing edge.

Figure 11A:
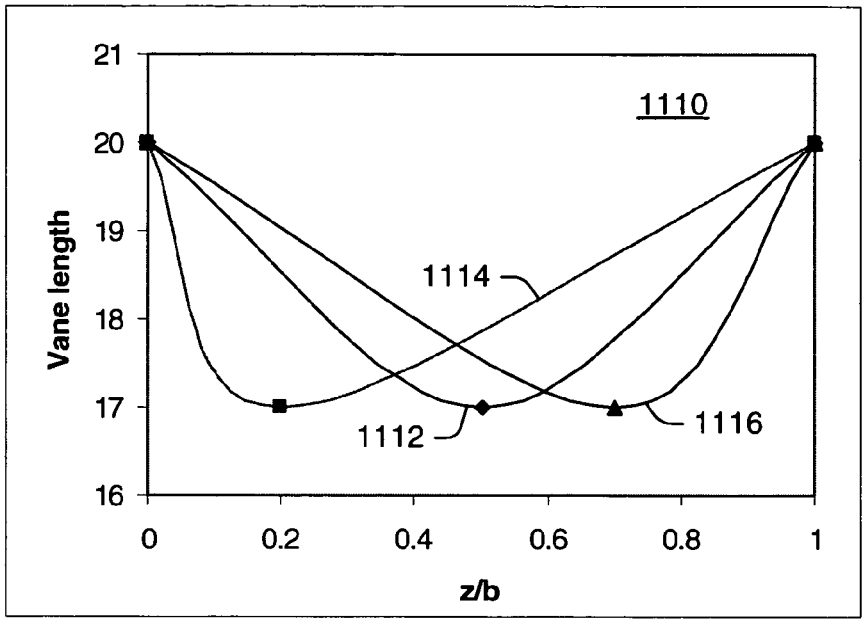
FIG. 11A is a plot of vane length versus a dimensionless Z value defined with respect to a b value for three exemplary vanes.

FIG. 11A is a plot 1110 of vane length versus a dimensionless Z value defined with respect to a b value for three exemplary vanes 1112, 1114, 1116. In general, vane length corresponds to length along the camberline; however, as shown in FIG. 7B, chord length may be used as an alternative. As shown, the exemplary vanes have a vane length with a minimum between a hub end (e.g., z/b=0) and a shroud end (e.g., z/b=1). In these examples, vane length (e.g., along a camberline) decreases by about 10% between the hub end and shroud end. For the vane 1112, the minimum length is at the midpoint of the trailing edge, for the vane 1114, the minimum length is closer to the hub end and, for the vane 1116, the minimum length is closer to the shroud end. Of course, a minimum may exist at an end, depending on particular purpose of the vane (e.g., efficiency, fatigue, etc.).

Figure 11B:
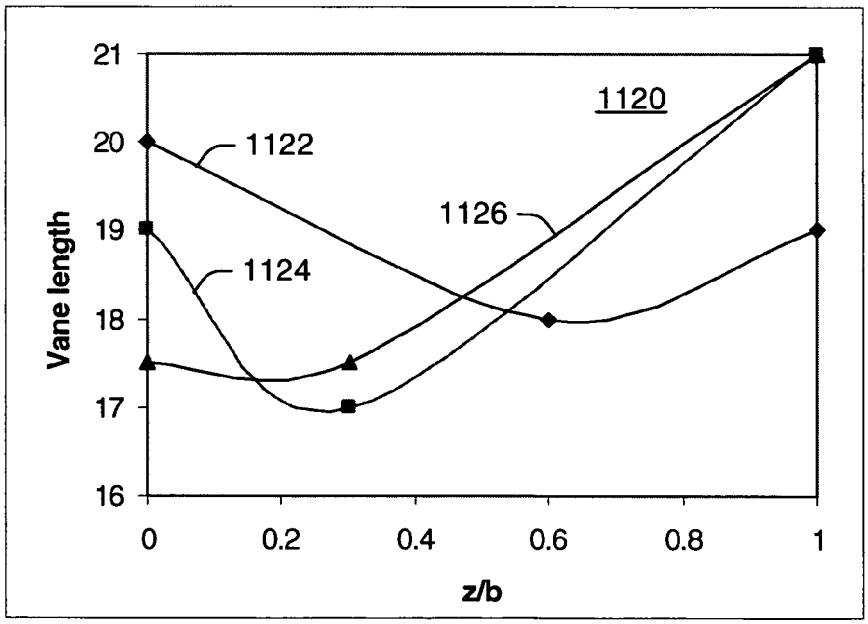
FIG. 11B is a plot of vane length versus a dimensionless Z value defined with respect to a b value for three exemplary vanes.

FIG. 11B is a plot 1120 of vane length versus a dimensionless Z value defined with respect to a b value for three exemplary vanes 1122, 1124, 1126. In general, vane length corresponds to length along the camberline; however, as shown in FIG. 7B, chord length may be used as an alternative. As shown, the exemplary vanes have a vane length with a minimum between a hub end (e.g., z/b=0) and a shroud end (e.g., z/b=1). In these examples, vane length decreases by about 10% from a maximum vane length. For the vane 1122, the minimum length is near the midpoint of the trailing edge, for the vane 1124, the minimum length is closer to the hub end and, for the vane 1126, the minimum length is closer to the hub end yet the angle at the hub end is about the same as the minimum length. Of course, a minimum may exist at an end, depending on particular purpose of the vane (e.g., efficiency, fatigue, etc.).

Figure 12A:
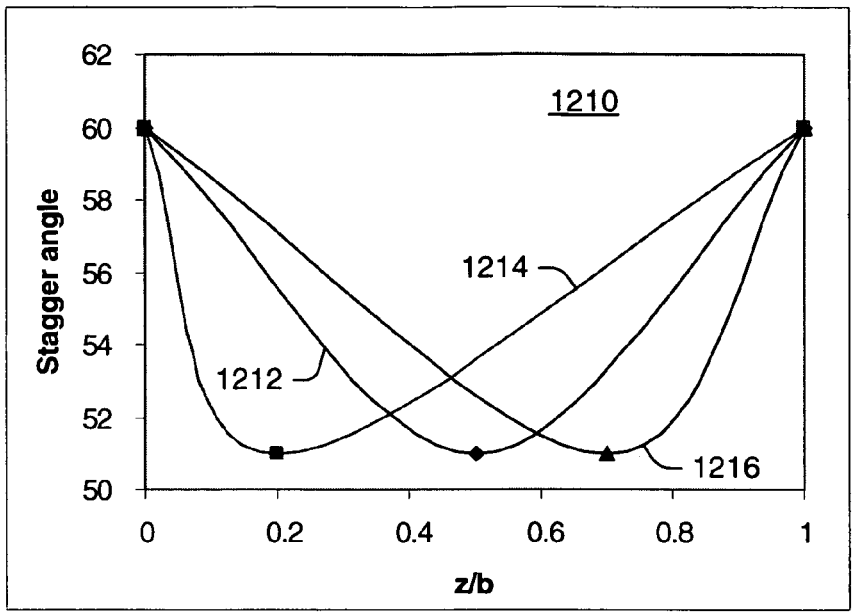
FIG. 12A is a plot of stagger angle versus a dimensionless Z value defined with respect to a b value for three exemplary vanes.

FIG. 12A is a plot 1210 of stagger angle Φ versus a dimensionless Z value defined with respect to a vane b value for three exemplary vanes 1212, 1214, 1216. As shown, the exemplary vanes have a stagger angle Φ with a minimum between a hub end (e.g., z/b=0) and a shroud end (e.g., z/b=1).

In these examples, stagger angle Φ decreases by about 10% between the hub end and shroud end. The change in stagger angle Φ with respect to vane height, as described above, may be due solely to the trailing edge, i.e., a change in the modified stagger angle $\Phi_M$. For the vane 1212, the minimum stagger angle Φ is at the midpoint of the trailing edge, for the vane 1214, the minimum stagger angle Φ is closer to the hub end and, for the vane 1216, the minimum stagger angle Φ is closer to the shroud end. Of course, a minimum may exist at an end (e.g., shroud end or hub end), depending on particular purpose of the vane (e.g., efficiency, fatigue, etc.). Again, adjacent vanes will typically have a wider throat at the minimum modified stagger angle $\Phi_M$.

Various exemplary vanes may create a throat that is widest at the shroud end or widest at the hub end.

Various exemplary vanes may have a constant overall chord length ($X_{Total}$), yet differ in shape along the z-axis. For example, referring to FIG. 7B, the chord lengths $X_{LE}$ and $X_{TE}$ may differ while $X_{Total}$ remains constant with respect to the z-axis. In such an example, the leading edge 426 and the trailing edge 424 would vary with respect to the z-axis. Overall chord length may also remain constant while a vane's cross-sectional area varies. While examples of vanes with varying modified stagger angle $\Phi_M$ are shown, other exemplary vanes optionally have a constant modified stagger angle $\Phi_M$.

Figure 12B:
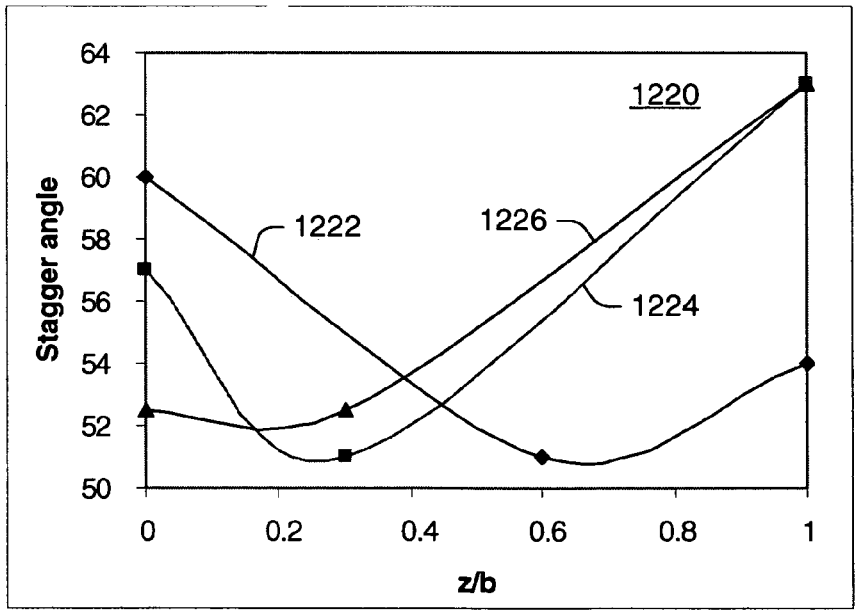
FIG. 12B is a plot of stagger angle versus a dimensionless Z value defined with respect to a b value for three exemplary vanes.

FIG. 12B is a plot 1220 of stagger angle Φ versus a dimensionless Z value defined with respect to a vane b value for three exemplary vanes 1222, 1224, 1226. For a conventional vane, the stagger angle Φ (defined by the leading and trailing edges) is the pivot angle of the vane and it typically does not change with respect to vane height. In contrast, the exemplary vanes according to the plots 1222, 1224, 1226 have a stagger angle Φ that varies with respect to vane height. In the examples of FIGS. 12A and 12B, the pivot angle may be assumed to be about 60° (e.g., based on a hub end or a shroud end leading edge-to-trailing edge stagger angle).

As already mentioned, the stagger angle Φ may vary due to variations in the trailing edge (i.e., due to variations in the modified stagger angle $\Phi_M$). As shown, the exemplary vanes have a stagger angle Φ with a minimum between a hub end (e.g., z/b=0) and a shroud end (e.g., z/b=1). In these examples, stagger angle Φ decreases by about 10% from a maximum stagger angle Φ. For the vane 1222, the minimum stagger angle Φ is near the midpoint of the trailing edge, for the vane 1224, the minimum stagger angle Φ is closer to the hub end and, for the vane 1226, the minimum stagger angle Φ is closer to the hub end yet the angle at the hub end is about the same as the minimum stagger angle Φ.

Of course, a minimum may exist at an end (e.g., shroud end or hub end), depending on particular purpose of the vane (e.g., efficiency, fatigue, etc.). As described herein, adjacent vanes will typically have a wider throat at the minimum modified stagger angle $\Phi_M$.

As described above, various exemplary vanes include a hub end and a shroud end that define vane height, a leading edge and a trailing edge that define vane length along a camberline and an inner surface and an outer surface that extend from the hub end to the shroud end and meet at the leading edge and the trailing edge and that define vane thickness. Various exemplary vanes include, for at least a portion of the vane, a vane length that varies with respect to vane height. Various exemplary vanes include, for at least a portion of the vane, a vane thickness that varies with respect to vane height. Of course, some exemplary vanes may include, for at least a portion of the vane, a vane length and a vane thickness that vary with respect to vane height. Various exemplary vanes include three-dimensional shapes that form advantageous throat shapes when positioned along a common radius (e.g., a pivot radius).

Figure 13:
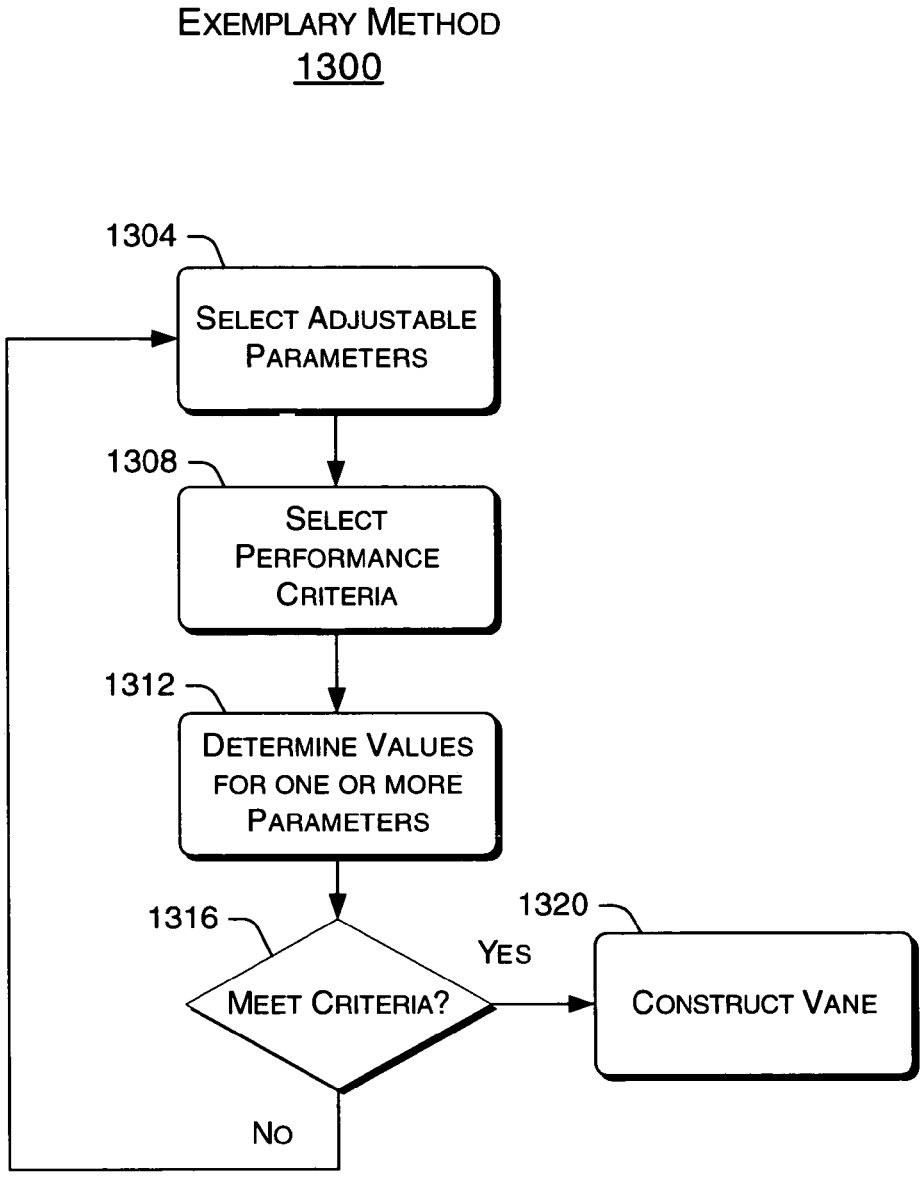
FIG. 13 is a block diagram of an exemplary method for determining vane shape with respect to various parameters wherein such parameters may vary with respect to an axial dimension.

FIG. 13 is a block diagram of an exemplary method 1300 for determining vane shape with respect to various parameters wherein such parameters may vary with respect to an axial dimension.

In a selection block 1304, selection of various parameters occurs whereby values for such parameters may be adjusted with respect to performance criteria. Another selection block 1308 provides for selection of one or more performance criteria (e.g., efficiency, fatigue, noise, etc.). A determination block 1312 optionally relies on computational software for heat transfer, mass transfer, fluid dynamics, stress, noise, etc., to determine values for one or more of the parameters, wherein at least one of the parameters corresponds to a dimension of a vane that varies with respect to a z-axis (e.g., a pivot axis of the vane, an axis of rotation of a wheel, etc.). A decision block 1316 follows whereby a decision is made as to whether the performance criteria have been met. If the criteria are not met, then the exemplary method 1300 may continue at the selection block 1304 or at the selection block 1308. If the criteria are met, then the exemplary method 1300 may continue at the construction block 1320 wherein construction of an exemplary vane occurs according, substantially, to the one or more parameter values determined by the determination block 1312.

An exemplary method includes selecting one or more vane parameters related to a throat shape where a trailing edge of one vane and an inner surface of an adjacent vane define the throat shape, selecting stress-related performance criteria for a turbine wheel, and determining a value for each the one or more vane parameters, based at least in part on the stress-related performance criteria of the turbine wheel, where the value or values correspond to a throat shape having a maximum width located between a hub end and a shroud end of the vanes. For example, the maximum width may be located as to reduce stress on the turbine wheel.

As discussed herein, variables related to vane shape include, but are not limited to, chord length, chord segments (i.e., as measured from the pivot axis), stagger angle, modified stagger angle, and camberline.

In one example, a chord segment from the pivot axis to the trailing edge may vary due to an arcuate trailing edge (e.g., curved inward generally toward the pivot axis of the vane).

In such an example, the camberline may optionally be constant with respect to vane height or vary with respect to vane height.

As discussed herein, variable nozzle geometry turbines are widely used in commercial and passenger vehicles.

Vehicle fuel efficiency and drivability are strongly affected by the efficiency of various turbocharger components. There is therefore constant commercial pressure to improve turbocharger efficiency. The aforementioned technology concerns vane shape modifications that can apply to variable geometry turbines and result in appreciable turbine efficiency improvements. In general, vane shape may be selected to reduce noise, fatigue or address other concerns.

Various exemplary vanes consider shape in three-dimensions where, for example, profile may vary in size, orientation and shape along the axial direction or other directions. Referring again to FIG. 5, in this example, various exemplary vanes have vane length and/or the angle between vane chord and the radial direction (modified stagger angle) which are reduced in a middle region of the vane. Various exemplary vane shapes disclosed herein result in an increase in flow area near the middle of the throat and a reduction in flow near end walls. Such exemplary vanes can produce improvements in stage efficiency via various mechanisms. For example, such vanes may lead to a reduction in vane total pressure loss due to reductions in endwall/tip clearance losses or a reduction in wheel loss due to incidence improvements in the middle of a throat.

Various exemplary vanes may also help improve high cycle fatigue characteristics of a downstream rotor by reduction of shock-wave strength in the middle of the throat.

Such a reduction may result from the lower modified stagger angle and larger flow area near the middle of the throat. Reduction of the shock strength reduces the unsteady forcing function, which reduces the resulting rotor's alternating strains, which is important for the rotor's inducer vibrational mode (typically the most hazardous), where the maximum modal displacement is typically near the midspan of the rotor along its leading edge.

Various exemplary vanes are also of particular importance to the latest generation of radial turbines employing profiled leading edges for high cycle fatigue considerations. For example, leading edge profiling tends to introduce a spanwise variation in the flow incidence on the blades near midspan, which can penalize the steady state performance. As described herein, varying vane shape (e.g., modified stagger, length, profile, etc.) can be used to optimize the flow incidence for such arrangements.

Various exemplary vanes are interchangeable with conventionally used "two-dimensional" vanes (or stacked profile vanes) since the same actuation mechanism may typically be used. An exemplary method of construction optionally includes a casting or other process that differs from that used for conventional vanes.

With respect to conventional vanes, if a conventional vane is intersected at various axial locations by a plane normal to the turbocharger centerline (e.g., z-axis or axis of rotation), the resulting airfoil profiles are identical in shape and orientation in space along the centerline. As described herein, various exemplary vanes have one or more dimensions, features, etc., that vary along the centerline of a turbine or other wheel (and/or along a pivot axis of an exemplary vane). Thus, various exemplary vanes have profiles that vary in shape, size, orientation, etc., in the axial direction to further optimize a turbine stage aero/mechanical performance.

What is claimed is:

1. A vane for a radial turbine assembly, the vane comprising:

a hub end and a shroud end that define vane height with respect to a radial turbine;

an arcuate leading edge and an arcuate trailing edge that define vane length and that define a minimum vane length along a camberline, the minimum vane length located between the hub end and the shroud end; and an inner surface and an outer surface that extend from the hub end to the shroud end and meet at the leading edge and the trailing edge and that define vane thickness;

wherein, for at least a portion of the vane, vane length and vane thickness vary with respect to vane height.

2. The vane of claim 1 further comprising a vane pivot axis extending from the hub end to the shroud end.

3. The vane of claim 2 further comprising a post positioned substantially along the pivot axis.

4. The vane of claim 2 further comprising a prong to facilitate rotation of the vane about the pivot axis.

5. The vane of claim 1 further comprising an identical vane positioned adjacent the vane to thereby form a throat between the trailing edge of the vane and the inner surface of the identical vane wherein, for at least a portion of the throat, throat width varies with respect to vane height.

6. The vanes of claim 5 wherein the throat has a maximum width between the hub end and the shroud end.

7. A variable geometry mechanism for a radial turbine, the mechanism comprising:

a plurality of vanes wherein each vane includes a hub end and a shroud end that define vane height with respect to a radial turbine, an arcuate leading edge and an arcuate trailing edge that define vane length and that define a minimum vane length along a camberline, the minimum vane length located between the hub end and the shroud end, and an inner surface and an outer surface that extend from the hub end to the shroud end and meet at the leading edge and the trailing edge and that define vane thickness wherein, for at least a portion of each vane, vane length and vane thickness vary with respect to vane height and wherein adjacent vanes form a throat defined by a trailing edge of one vane and an inner surface of another vane; and adjustment means for adjusting the plurality of vanes.

8. The variable geometry mechanism of claim 7 wherein each throat has a maximum width located between the hub ends and the shroud ends of adjacent vanes.

9. The variable geometry mechanism of claim 7 wherein the hub ends and the shroud ends comprise substantially crescent shapes.

10. The variable geometry mechanism of claim 7 wherein the outer surfaces are convex and the inner surfaces are concave.

11. The variable geometry mechanism of claim 7 wherein stagger angle of each vane has a minimum located between the hub end and the shroud end of the vane.

12. A turbine assembly comprising:

a radial turbine wheel having an axis of rotation; and a variable geometry mechanism that comprises a plurality of vanes wherein each vane includes a hub end and a shroud end that define vane height parallel to the axis of rotation of the turbine wheel, an arcuate leading edge and an arcuate trailing edge that define vane length and that define a minimum vane length along a camberline, the minimum vane length located between the hub end and the shroud end, and an outer surface substantially facing away from the turbine wheel and an inner surface substantially facing the turbine wheel that extend from the hub end to the shroud end and meet at the leading edge and the trailing edge and that define vane thickness wherein, for at least a portion of each vane, vane length and vane thickness vary with respect to vane height and wherein adjacent vanes form a throat defined by a trailing edge of one vane and an inner surface of another vane wherein the throat has a maximum width between the hub end and the shroud end; and adjustment means for adjusting the plurality of vanes to thereby adjust throats with respect to the turbine wheel.

13. A turbine assembly comprising:

a radial turbine wheel having an axis of rotation; and a variable geometry mechanism that comprises a plurality of vanes wherein each vane includes a hub end and a shroud end that define vane height parallel to the axis of rotation of the turbine wheel, an arcuate leading edge and an arcuate trailing edge that define vane length and that define a minimum vane length along a camberline, the minimum vane length located between the hub end and the shroud end, and an outer surface substantially facing away from the turbine wheel and an inner surface substantially facing the turbine wheel that extend from the hub end to the shroud end and meet at the leading edge and the trailing edge and that define vane thickness wherein, for at least a portion of each vane, vane stagger angle varies with respect to vane height and wherein adjacent vanes form a throat defined by a trailing edge of one vane and an inner surface of another vane; and adjustment means for adjusting the plurality of vanes to thereby adjust throats with respect to the turbine wheel.

14. The turbine assembly of claim 13 wherein vane height varies with respect to vane length along the camberline.

15. The turbine assembly of claim 13 wherein vane thickness varies with respect to vane height.

16. The turbine assembly of claim 13 wherein vane length along the camberline and vane thickness vary with respect to vane height.

17. The turbine assembly of claim 13 wherein the stagger angle comprises a modified stagger angle based in part on a pivot axis and a trailing edge of a vane.

* * * * *